United States Patent [19]

Ingaglio

[11] 4,399,609

[45] Aug. 23, 1983

[54] SPADE LUG RECEPTACLE FITTING TOOL

[75] Inventor: Michael L. Ingaglio, Randolph, N.J.

[73] Assignee: Bell Telephone Laboratories, Incorporated, Murray Hill, N.J.

[21] Appl. No.: 333,763

[22] Filed: Dec. 23, 1981

[51] Int. Cl.[3] ..... H01R 43/00

[52] U.S. Cl. ..... 29/747; 29/758

[58] Field of Search ..... 29/747, 758, 750–752, 29/278, 854–856

[56] References Cited

U.S. PATENT DOCUMENTS 3,574,254 4/1971 Harris ..... 29/747

FOREIGN PATENT DOCUMENTS 2458945 6/1976 Fed. Rep. of Germany ..... 29/747

*Primary Examiner*—Carl E. Hall

*Attorney, Agent, or Firm*—W. H. Kamstra

[57] ABSTRACT

A tool (10) for fitting a "flag" type conductor terminating receptacle (11) on a spade lug terminal (12) of an electrical component (16). The tool (10) comprises a circular rod (21), one end of which is formed to present a tab (23) cut along a chord of the rod (21) cross section, the tab (23) having an inner surface (24) tangent to a bore (22) formed in the rod transverse to its longitudinal axis. The tab (23) thus formed extends beyond the main portion of the rod and defines a slot (25) permitting access to the bore (22) from the rod end. The receptacle (11) to be fitted is held by the tool (10) by inserting the roll of the crimped conductor into the rod bore (22) the end tab (23) supporting the rear face (27) of the receptacle (11).

3 Claims, 3 Drawing Figures

SPADE LUG RECEPTACLE FITTING TOOL

TECHNICAL FIELD

This invention relates to devices and apparatus for interconnecting electrical conductors and terminals of electrical components and the like, and more particularly, to tools for facilitating such interconnection.

BACKGROUND OF THE INVENTION

Terminals of electronic components to which electrical conductors may be connected have taken various and numerous forms, generally as determined by the manner in which the conductors are to be attached, which in turn is determined by the permanence of the connection desired. One widely used terminal commonly called a spade lug, when employed in association with a special conductor termination, permits a quick connection and disconnection of the two elements. The lug terminal comprises a rectangular flat strip presenting two opposite parallel edges. The conductor is crimped or otherwise electrically secured to a terminal receptacle comprising a flat, generally rectangular strip, the opposite sides of which are folded over to receive the opposite edges of the spade lug terminal. With the receptacle frictionally fitted on the lug terminal, a connection is made which is both mechanically and electrically reliable.

In the past, the receptacle has been fitted on the lug terminal either manually or by whatever shop tool was most convenient. This has proved awkward, particularly when a number of the lug terminals are closely spaced and frequently inconvenient when access to a lug terminal is limited. It is accordingly an object of the invention to provide a tool for facilitating the fitting of a conductor receptacle on a spade lug terminal, which tool is both simple and has a low cost.

SUMMARY OF THE INVENTION

The foregoing and other objects are realized in one illustrative tool according to the invention comprising a circular rod formed at one end to present a tab extending tangentially from a bore transverse to the longitudinal axis of the rod. The tab extends beyond the major portion of the rod and defines a slot permitting access to the bore. The other end of the rod is fitted with a knob for ease of handling. The tool is advantageously operated to fit a "flag" type receptacle to a spade lug terminal. Such a receptacle provides for the crimping of a conductor at its conductor contact section by enfolding the section about the conductor to form a roll transverse to the lug clasping receptacle, leaving the conductor at right angles to the latter receptacle. The roll thus formed is fitted into the bore of the tool, its end tab lying along the rear face of the receptacle. With the receptacle thus held, it is readily fitted on a spade lug terminal, the rod being of sufficient length to reach the terminal despite limited access.

BRIEF DESCRIPTION OF THE DRAWING

A conductor receptacle fitting tool and its operation according to the principles of the invention will be better understood from a consideration of the detailed description of one illustrative embodiment thereof which follows when taken in conjunction with the accompanying drawing in which.

DETAILED DESCRIPTION

Figure 1:
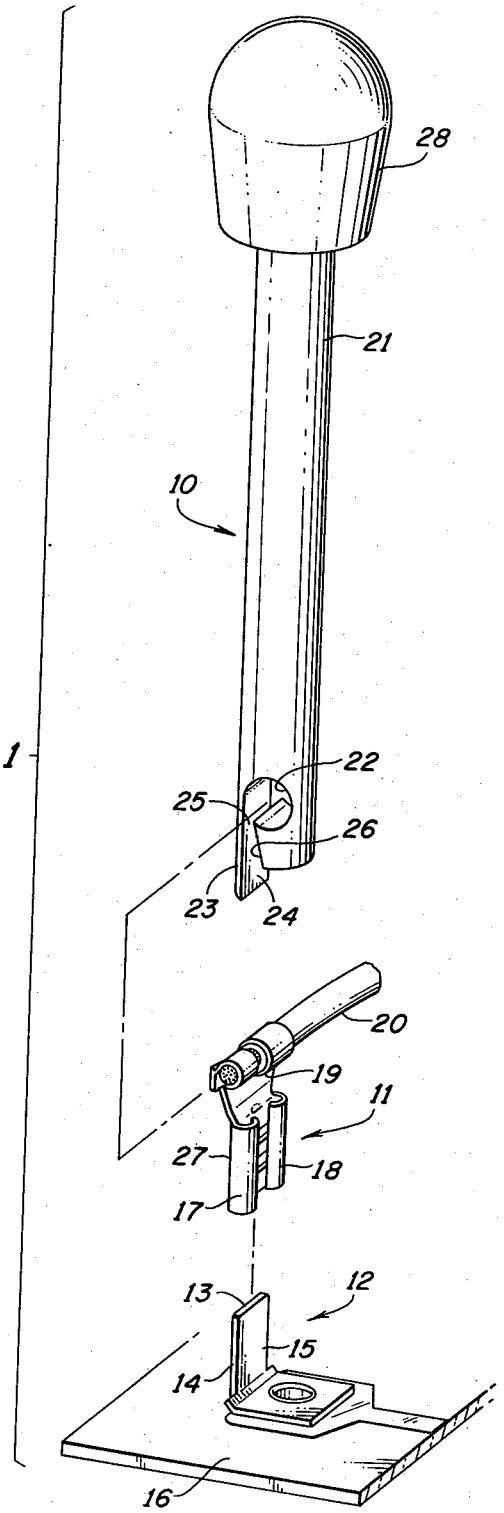
FIG. 1 is a perspective view of an illustrative spade lug receptacle tool according to the invention shown in position preparatory to its operation in fitting a typical conductor receptacle to a spade lug terminal.

Referring now to the drawing, a spade lug terminal receptacle fitting tool 10 according to the invention is seen in FIG. 1 preparatory to fitting a conventional conductor "flag" type receptacle 11 to a spade lug terminal 12. The latter terminal comprises an electrically conductive strip 13 having opposite parallel edges 14 and 15 which terminal extends from or may be affixed to an electrical component such as, for example, an electrical circuit board 16, a portion of which is shown. Receptacle 11 comprises an electrically conductive strip having parallel folded over sides 17 and 18 adapted to frictionally clasp terminal lug 13 at its edges 14 and 15, respectively. Extending at right angles from one end of folded sides 17 and 18 is a conductor section 19 which is rolled about a conductor 20 to achieve electrical contact and strain relief as is also known.

Figure 2:
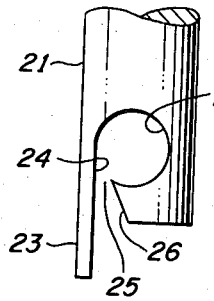
FIG. 2 is a side view of the operative end of the tool of FIG. 1.
Figure 3:
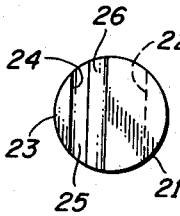
FIG. 3 is an end view of the tool shown in the foregoing figures.

Tool 10 comprises a rod 21 of any suitable sturdy material having, in the illustrative embodiment described, a substantially circular cross-section, which rod has a circular bore 22 formed therein a short distance from one end (see also FIGS. 2 and 3) substantially transverse to the longitudinal axis of rod 21. Rod 21 is further formed to present a tab 23 extending from its end having a surface 24 along a chord of the cross-section substantially tangent to the surface of bore 22. A slot 25 is thus formed to permit access to bore 22 from the end of rod 21. The remainder of the end of rod 21 is formed to terminate well short of the end of tab 23 and to present an angled face 26 extending from bore 22 and the end of rod 21. A knob 28, fitted at the other end of rod 21 for ease of handling, completes the assembly and construction of tool 10. The length of rod 21 is determined for convenience in the physical environment in which tool 10 is to be used.

Tool 10 is simply operated by inserting the rolled conductor contact section 19 of receptacle 11 into bore 22 of rod 21 as indicated by the broken line in FIG. 1. Tab 23, slot 25, and face 26 are so dimensioned that face 26 bears slightly on the forward face of contact section 19 between the conductor roll and the ends of folded over sides 17 and 18 of receptacle 11. When so fitted together, surface 24 of tab 23 will bear against the rear face 27 of the receptacle and the end of rod 21 will bear against the ends of sides 17 and 18. Tool 10 is now handled to fit receptacle 11 over spade lug terminal 12.

What has been described is considered to be only one specific illustrative spade lug receptacle fitting tool according to the invention. Accordingly, it is to be understood that various and numerous other arrangements may be devised by one skilled in the art without departing from the spirit and scope of the invention as limited only by the accompanying claims.

What is claimed is:

1. A tool for fitting a conductor receptacle to a spade lug terminal, said receptacle having a pair of folded over sides for receiving the sides of said terminal and a conductor contact section folded about said conductor at substantially right angles to said folded over sides, said tool comprising a rod having a bore formed therein at one end substantially transverse to its longitudinal axis dimensioned to receive the folded conductor contact section of said receptacle, said one end of said rod further having a slot formed therein to said bore, said slot having walls substantially parallel to the central axis of said bore, and a tab extending beyond said one end of said rod, said tab having a surface comprising one wall of said slot substantially tangent to the inner surface of said bore, the other wall of said slot and the end of said rod being dimensioned to bear against one side of said conductor contact section and the ends of said folded over sides, respectively, of said receptacle and said tab being dimensioned to bear on the other side of said receptacle when said folded conductor contact section of said receptacle is fitted into said bore.

2. A tool as claimed in claim 1 in which said rod is of substantially circular cross-section and in which said surface of said tab lies along a chord of said cross-section.

3. A tool as claimed in claims 1 or 2 also comprising a knob fitted on the other end of said rod.

* * * * *